US007716755B1

(12) United States Patent
Wiens

(10) Patent No.: US 7,716,755 B1
(45) Date of Patent: May 18, 2010

(54) ATHLETIC GARMENT

(76) Inventor: Joel J. Wiens, 2767 Highway 55, Eagan, MN (US) 55121

( * ) Notice: Subject to any disclaimer, the term of this patent is extended or adjusted under 35 U.S.C. 154(b) by 521 days.

(21) Appl. No.: 11/699,773

(22) Filed: Jan. 29, 2007

Related U.S. Application Data

(60) Provisional application No. 60/763,130, filed on Jan. 30, 2006.

(51) Int. Cl.
*A41D 13/00* (2006.01)
*A41D 1/06* (2006.01)

(52) U.S. Cl. ..... 2/466; 2/228

(58) Field of Classification Search ..... 2/22, 2/23, 24, 466, 227, 228, 267, 403, 404
See application file for complete search history.

(56) References Cited

U.S. PATENT DOCUMENTS 759,833 A 5/1904 Stall
1,229,850 A * 6/1917 Zetosch ..... 602/68
1,381,254 A * 6/1921 Thorp ..... 602/72
1,421,077 A * 6/1922 Goldsmith ..... 602/71
1,602,454 A * 10/1926 Riddell ..... 2/23
1,689,558 A * 10/1928 Patten ..... 2/22
1,698,674 A * 1/1929 Crego et al. ..... 2/230
1,920,943 A * 8/1933 Thompson ..... 2/240
2,088,302 A * 7/1937 McKeever ..... 602/67
2,336,222 A * 12/1943 Clark ..... 66/176
2,561,872 A 7/1951 Krinick
2,757,381 A * 8/1956 Trentesaux et al. ..... 2/237
3,209,370 A * 10/1965 Miller ..... 2/232
3,499,443 A * 3/1970 Scheerer ..... 602/68
4,035,844 A * 7/1977 Atack et al. ..... 2/466
4,089,064 A * 5/1978 Chandler, Jr. ..... 2/78.2
4,091,466 A * 5/1978 Kearn ..... 2/23
4,156,294 A * 5/1979 Horn ..... 2/400
4,266,297 A * 5/1981 Atkins ..... 2/2.5
4,325,148 A * 4/1982 Livernois ..... 2/465
4,389,733 A * 6/1983 Boykins, Jr. ..... 2/466
4,453,541 A * 6/1984 Castelli et al. ..... 602/72
4,561,123 A 12/1985 Hull
4,967,768 A * 11/1990 Tatro ..... 128/891
4,989,594 A * 2/1991 Doherty et al. ..... 602/72
5,003,972 A * 4/1991 Kestler ..... 602/70
5,133,093 A * 7/1992 Tsuchiya ..... 2/403
5,134,726 A * 8/1992 Ross ..... 2/465
5,243,974 A * 9/1993 Allen ..... 607/108
5,274,854 A * 1/1994 Wenner et al. ..... 2/403
5,295,267 A * 3/1994 Galindo ..... 2/466
5,377,693 A 1/1995 Loper et al.
5,384,913 A * 1/1995 Hendry ..... 2/22
5,452,477 A 9/1995 Mann
5,483,705 A * 1/1996 DiMatteo ..... 2/466
5,539,927 A * 7/1996 Holubec ..... 2/69
5,572,737 A 11/1996 Valice
5,689,836 A 11/1997 Fee et al.
5,819,323 A * 10/1998 Edenfield ..... 2/466
5,966,739 A * 10/1999 Wagner ..... 2/23
D418,966 S * 1/2000 Walsh ..... D2/712

(Continued)

*Primary Examiner*—Alissa L Hoey
(74) *Attorney, Agent, or Firm*—Richard John Bartz

(57) ABSTRACT

An athletic pants having a body joined to a waist band and legs. A cup pouch accommodating a jock cup is releasably connected to the waist band for adjusting the location of the cup pouch relative to the parts. Knee supports secured to the legs have cushions to protect a person's knees.

24 Claims, 13 Drawing Sheets

U.S. PATENT DOCUMENTS 6,048,327 A * 4/2000 Kieffer ..... 602/70
6,269,485 B1 8/2001 Foreman
6,305,031 B1 * 10/2001 White ..... 2/455
6,338,164 B1 * 1/2002 Howard ..... 2/242
6,374,410 B2 * 4/2002 Adamson ..... 2/24
D467,705 S * 12/2002 Leflet et al. ..... D2/742
6,637,036 B2 * 10/2003 Beland ..... 2/227
6,782,559 B2 * 8/2004 Regan ..... 2/455
6,804,832 B2 * 10/2004 Beland ..... 2/227
7,032,249 B2 * 4/2006 Smith ..... 2/78.2
7,089,596 B2 * 8/2006 Leflet et al. ..... 2/23
7,178,176 B1 * 2/2007 S-Cronenbold ..... 2/466
7,219,372 B2 5/2007 Frieler et al.
D554,826 S * 11/2007 Hart ..... D2/704
D579,628 S * 11/2008 Wiens ..... D2/711
7,496,973 B2 * 3/2009 Jewell et al. ..... 2/227
2003/0051288 A1 3/2003 Dugan
2006/0282938 A1 * 12/2006 Jewell et al. ..... 2/227

* cited by examiner

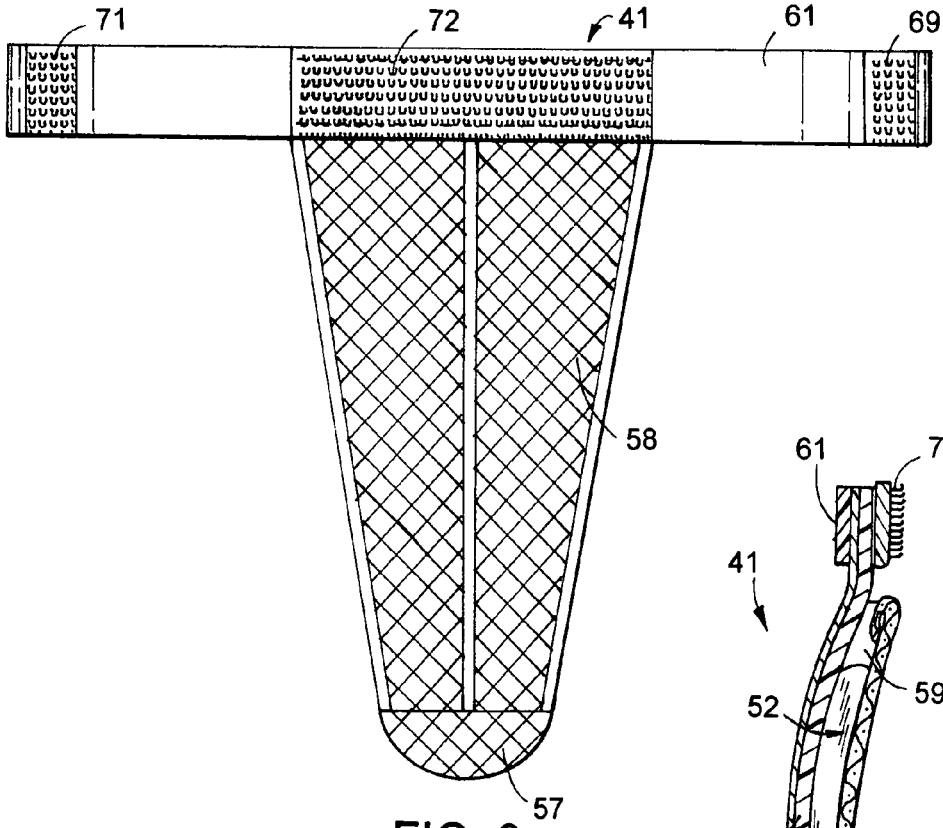
FIG. 9
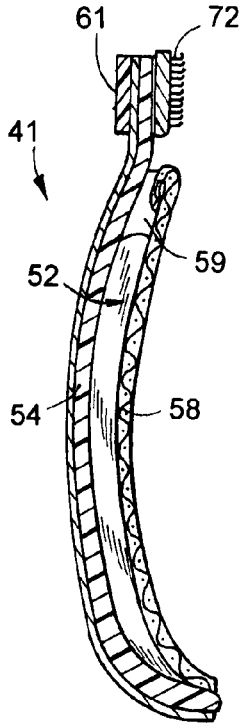
FIG. 11
FIG. 10
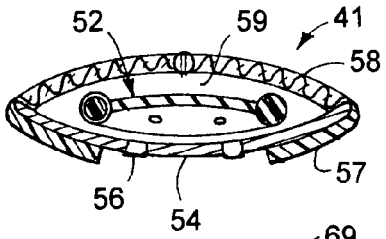
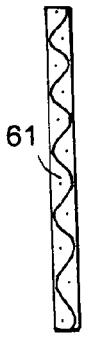
FIG. 12
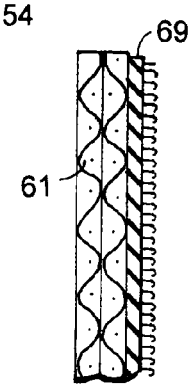
FIG. 13

ATHLETIC GARMENT

CROSS REFERENCE TO RELATED APPLICATION

This application claims the benefit of the priority of U.S. Provisional Patent Application Ser. No. 60/763,130 filed Jan. 30, 2006.

FIELD OF THE INVENTION

The invention relates to athletic garments having adjustable jock cup pouches and padded knee supports to protect a person's body. More particularly, the athletic garments are pants having a body with releasable fasteners for holding jock cup pouches in selected adjustable positions and legs connected to padded knee supports that protect a person's knees and legs from external impact forces.

BACKGROUND OF THE INVENTION

Greek and Roman legionnaires used body armor as protective covering as a defense against weapons and projectiles. This armor included breast, hip and leg members to protect the body and legs of legionnaires. Body armor is presently in use by the police and military. Protective sport garments are used in contact sports, such as baseball, softball, hockey, soccer, football and rugby. These garments include sport pants and trousers having jock cups and pads for protection from impacting forces from balls, sticks and player contact. Examples of protective sport garments are discloses in the following U.S. Patents.

W. T. Stall in U.S. Pat. No. 759,833 discloses a padded garment comprising a trouser having a plurality of pads permanently secured to the outer surface of its body and legs. The inner surface of the trouser is smooth and adapted to fit the wearer without irritation due to the pads. The pads include left and right thigh pads permanently secured to the materials of the trouser legs with stitching.

J. W. Atack et al in U.S. Pat. No. 4,035 discloses a trouser undergarment made of elastic stretchable material designed to fit the contours of the body of a person. Auxiliary pockets at the knees and thighs accommodate padding. The thigh pockets are stitched only on three sides with the top open to permit the insertion of padding.

W. L. Hull in U.S. Pat. No. 4,561,123 discloses a knee-pad having a flexible pad member attached above and below a person's knee. The pad member is attached to the legs of pants with releasable fasteners or straps having releasable connectors.

J. T. Ross in U.S. Pat. No. 5,134,726 discloses a sport pants having a trunk and legs of elastic stretchable material with hip and knee pockets for accommodating pads of resilient closed cell foam material which are removable and replaceable in the pockets for protection of the wearer. The front of the pants has a pocket for a pad or cup. The sport pants is washable underwear with padding to mitigate scrapes and bruises in athletic competition and games.

D. C. Strickland and M. T. Cheatwood in U.S. Pat. No. 6,161,222 discloses an athletic garment with guard members to protect the athletic inner thighs. The legs of the garment have pockets on the inside of the thigh portions of the garment's legs for holding pads. The pads are flexible so that they will conform to the shape of the thigh and bend when the athlete moves. In use, the pads absorb impact and shock forces of a ball or other blow to the inner thigh during sport activities. The pads are not removable from the pockets. The positions of the pads relative to the legs of the garment are not adjustable, as the pads are in fixed positions within the pockets.

The objects and advantages of the invention are embodied in the following description in connection with the accompanying drawings of a preferred embodiments of the athletic garment with adjustable jock cup pouches and padded knee supports.

SUMMARY OF THE INVENTION

The invention is a compression or a loose fitting athletic pants having an adjustable pouch for a jock cup and padded knee supports for protecting and supporting a person's knees. The pants has a body joined to an annular waist band and a pair of downwardly extended legs adapted to fit around to waist and legs of a person. The pouch for the jock cup is connected with releasable fasteners to the waist band that allow the location of the pouch to be adjusted to accommodate the body and organs of the person. The pouch location is vertically and horizontally adjustable to provide a comfortable fit of the jock cup. The releasable fasteners are hook and loop connectors secured to the waist band and a horizontal strap attached to the top of the pouch. The jock cup has a rigid convex curved V-shaped member having a continuous outer peripheral edge. A cylindrical cushion of compressible material has a slot accommodating the peripheral edge and securing the cushion to the member. The member has a plurality of air ventilation holes. In one embodiment of the invention the legs of the pants have knee sections that are adapted to extend around a person's knees. Supports attached to the knee sections extend around the knees to protect and support the person's knees. Each support has a body member attached with connectors to a knee section of the pants and a pair of arms joined to the body member. The body member and arms have flexible compression material that surround the knee section of the legs of the pants. Releasable connectors, such as hook and loop connectors, attach the arms to the body member to retain the support around the knee of the person and apply compression force to the knee.

DESCRIPTION OF THE DRAWING

FIG. 9 is a rear elevational view of the adjustable pouch of FIG. 4;

FIG. 10 is a sectional view taken along line 10-10 of FIG. 4;

FIG. 11 is a sectional view taken along the line 11-11 of FIG. 4;

FIG. 12 is a sectional view taken along the line 12-12 of FIG. 4;

FIG. 13 is a sectional view taken along the line 13-13 of FIG. 4;

DETAILED DESCRIPTION OF THE INVENTION

The following detailed description of the athletic garment with an adjustable jock cup pouch and padded knee supports is made with reference to the accompanying drawing by way of illustration of specific embodiments in which the invention may be practiced. It is to be understood that other embodiments may be utilized and structural changes be made without departing from the scope of the invention.

Figure 1:
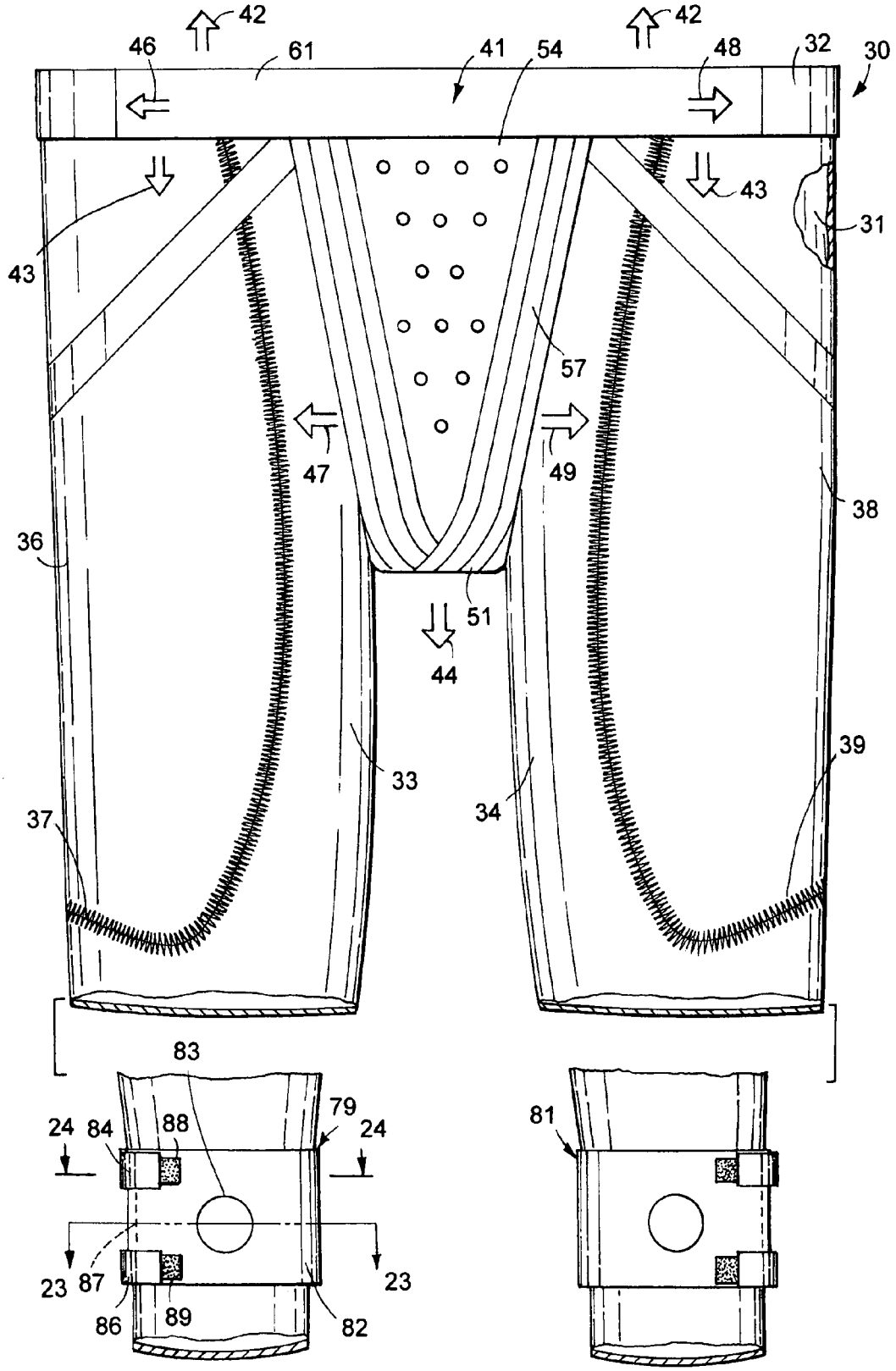
FIG. 1 is a foreshortened front elevational view of the athletic garment with an adjustable cup pouch and padded knee supports.

The athletic garment 30, shown in FIG. 1, is a human male pants having a body 31 secured to an annular waist band 32 and joined to tubular legs 33 and 34. Body 31 and legs 33 and 34 are compression fabrics that fit around a person's lower body and legs. Loose fabric can be used for body 31 and legs 33 and 34. The hip and outer leg portions of body 31 contain second layers of fabrics 36 and 38. Stitches 37 secure fabric 36 to leg 33 and adjacent body 31. Stitches 39 secure fabric 38 to leg 34 and adjacent body 31. An adjustable jock cup pouch 41 is located in front of the middle section of body 31. The bottom of pouch 41 is attached to crotch section 51 of body 31. Pouch 41 is adjustable upwardly in a vertical direction, shown by arrows 42, relative to body 31 and waist band 32 and downwardly, shown by arrows 43 and 44. Pouch 41 is also adjustable in right and left horizontal directions, shown by arrows 46, 47 and 48, 49, relative to body 31 and waist band 32. The vertical and horizontal adjustments of pouch allows the user to have a comfortable fit of jock cup 52, shown in FIGS. 10 and 11, located in the pocket of pouch 41.

As shown in FIGS. 4 to 9, pouch 41 has a V-shaped body 53 comprising a front member 54 with ventilation holes 56 surrounded with a ribbon 57. A back member 58 joined to ribbon 57 forms a pocket 59 accommodating jock cup 52. As shown in FIG. 11, the upper end of pocket 59 is open to allow jock cup 52 to be inserted into pocket 59. A horizontal flat strap 61 is secured to the upper ends of front member 54 and ribbon 57. Strap 61 is generally aligned horizontally with the front of waist band 32.

Figure 2:
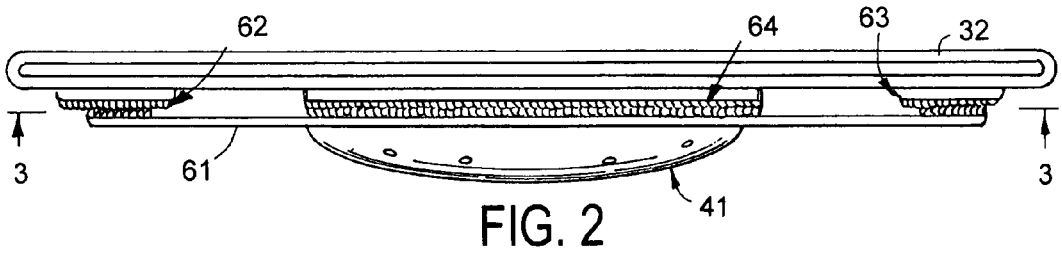
FIG. 2 is a top plan view of the garment of FIG. 1.
Figure 3:
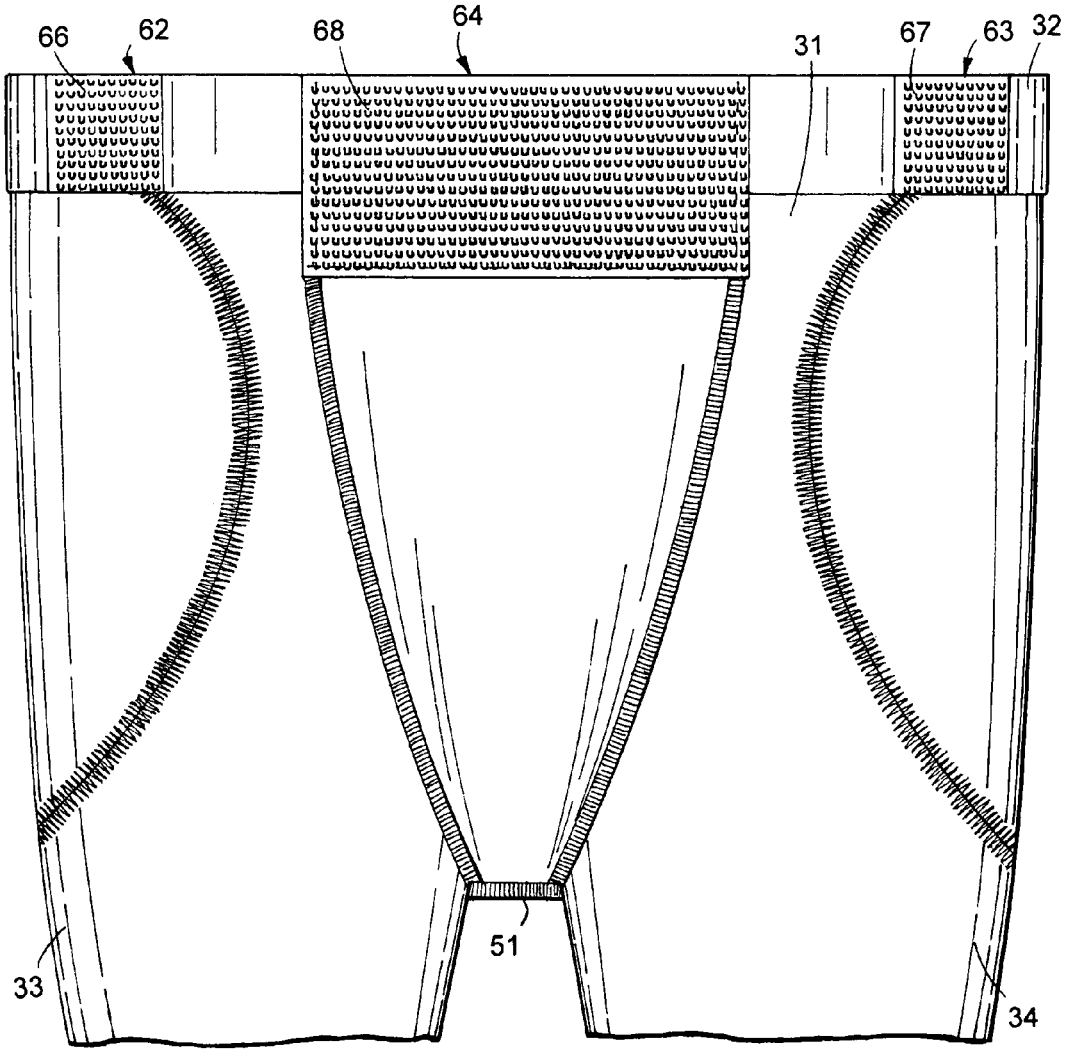
FIG. 3 is a sectional view taken along line 3-3 of FIG. 2.
Figure 4:
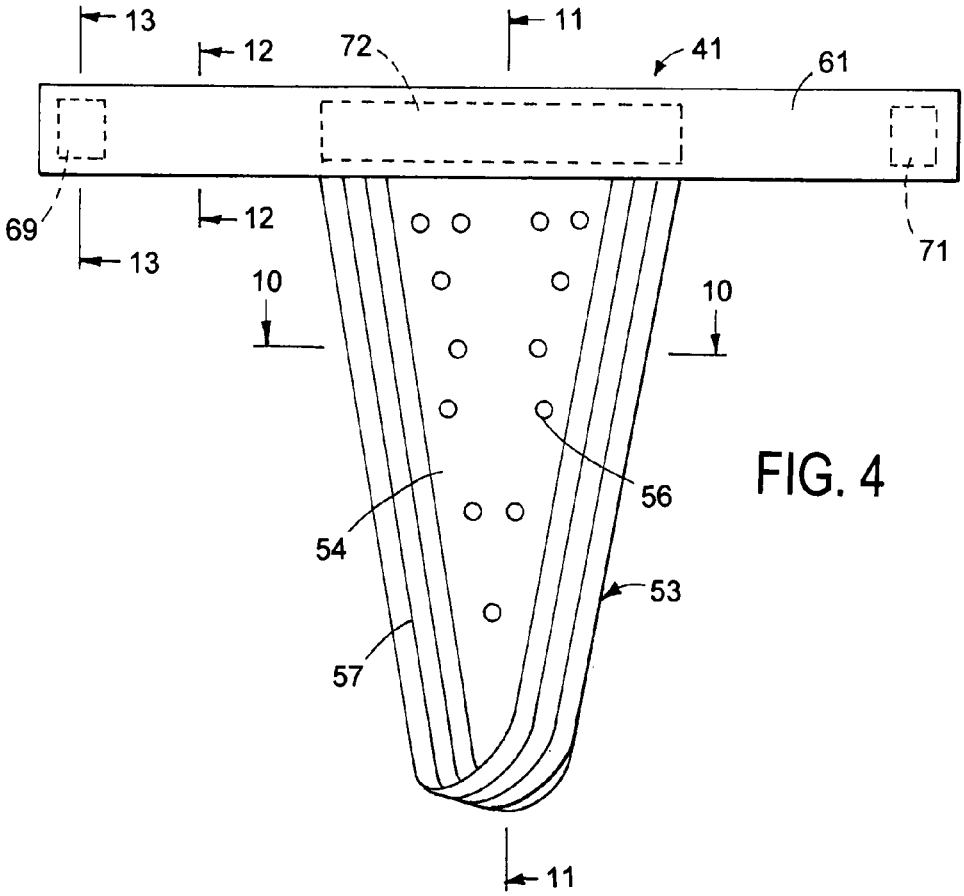
FIG. 4 is a front elevational view of the adjustable cup pouch of the garment of FIG. 1.
Figure 5:
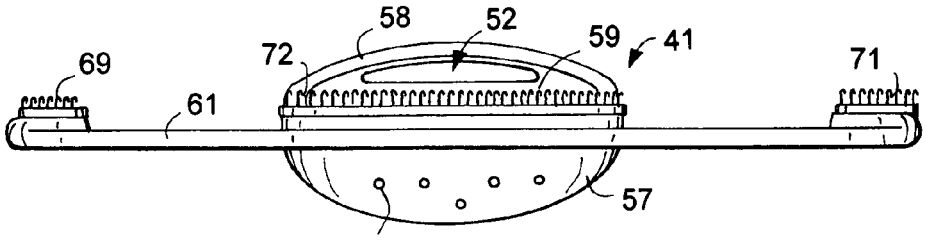
FIG. 5 is a top plan view of the adjustable pouch of FIG. 4.
Figure 6:
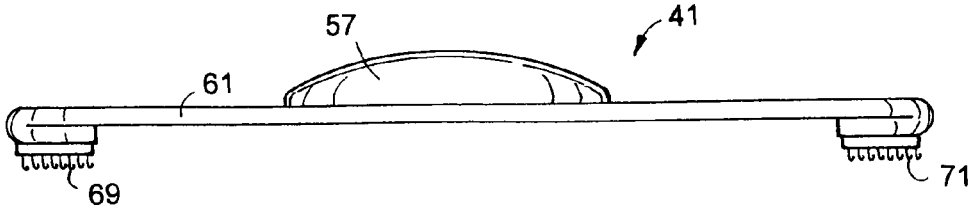
FIG. 6 is a bottom plan view of the adjustable pouch of FIG. 4.
Figure 7:
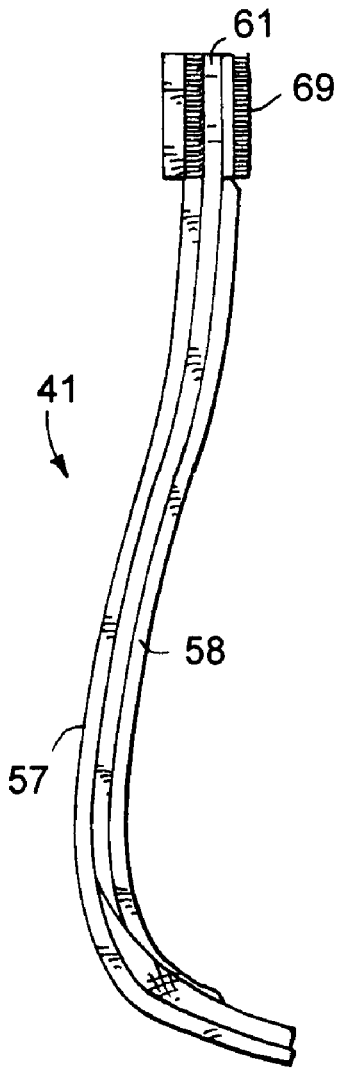
FIG. 7 is a side elevational view of the left side of the adjustable pouch of FIG. 4.
Figure 8:
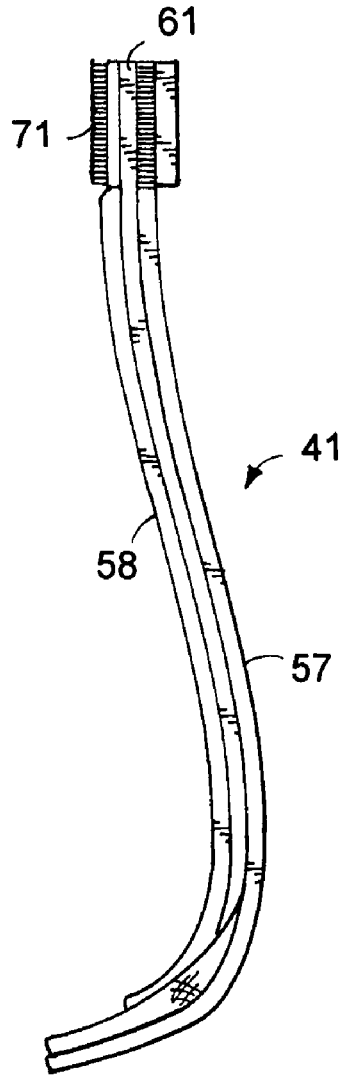
FIG. 8 is a side elevational view of the right side of the adjustable pouch of FIG. 4.
Figure 14:
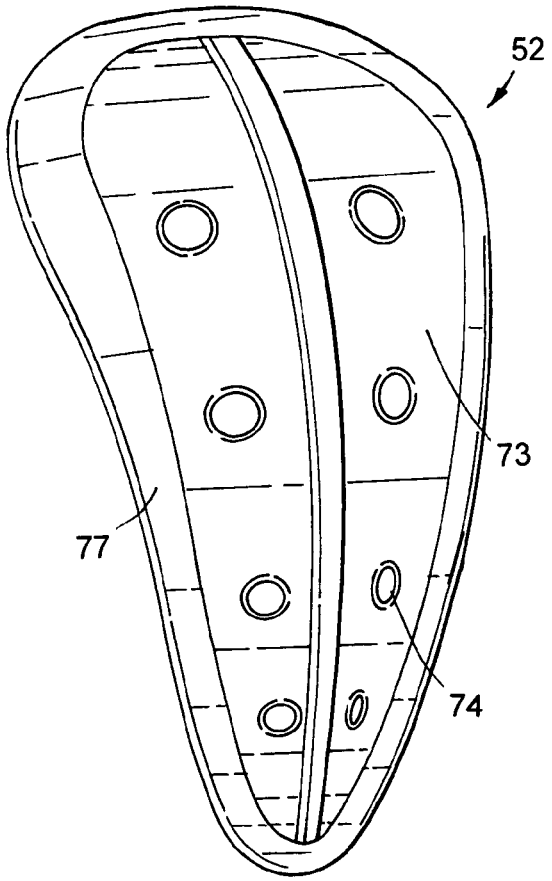
FIG. 14 is a perspective view of jock cup of the garment of FIG. 1.
Figure 15:
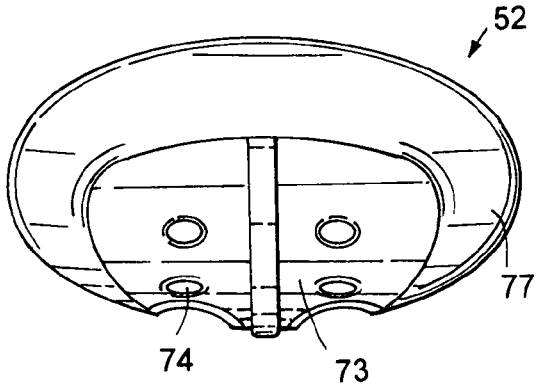
FIG. 15 is a top plan view of the jock cup of FIG. 14.
Figure 16:
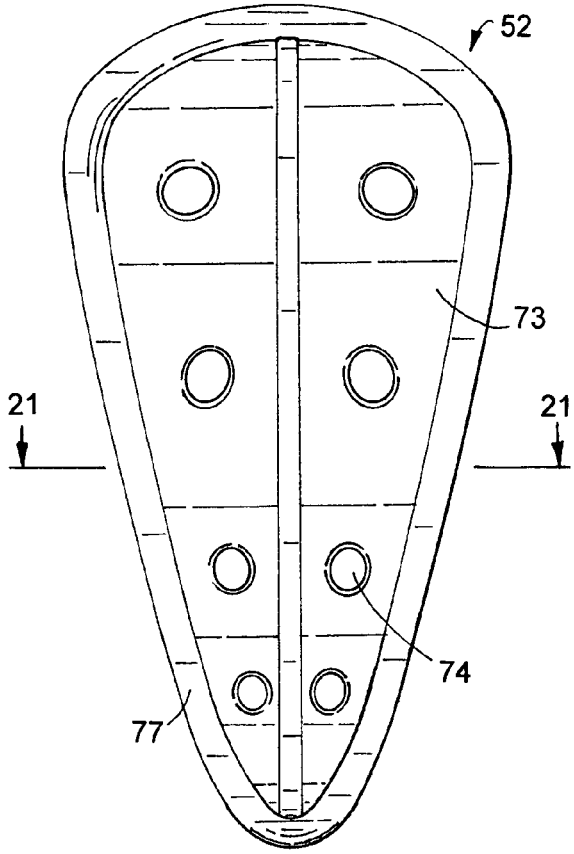
FIG. 16 is a front elevational view of the jock cup of FIG. 14.
Figure 17:
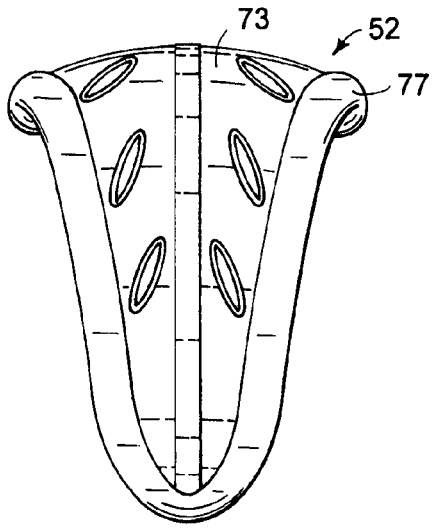
FIG. 17 is a bottom plan view of the jock cup of FIG. 14.
Figure 18:
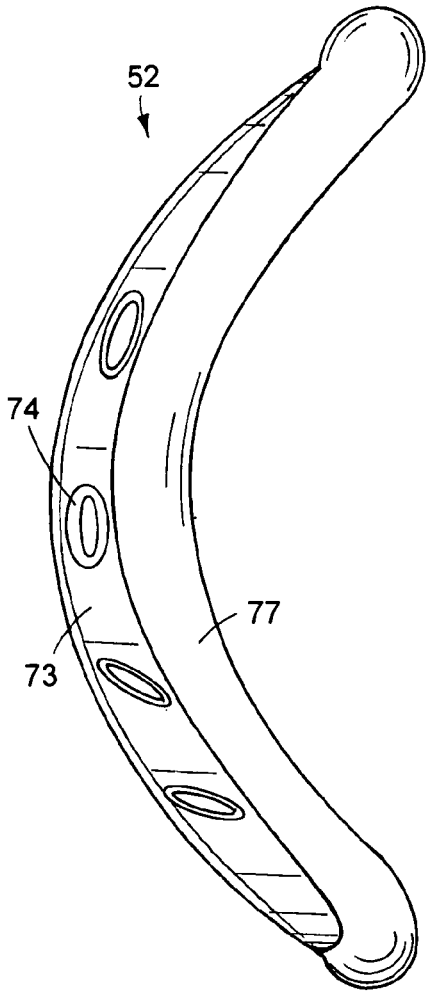
FIG. 18 is a side elevational view of the left side of the jock cup of FIG. 14.
Figure 19:
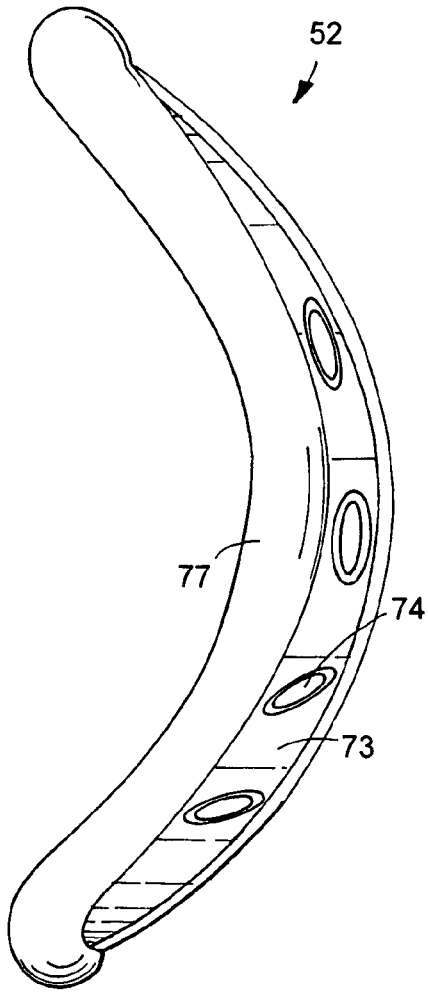
FIG. 19 is a side elevational view of the right side of the jock cup of FIG. 14.
Figure 20:
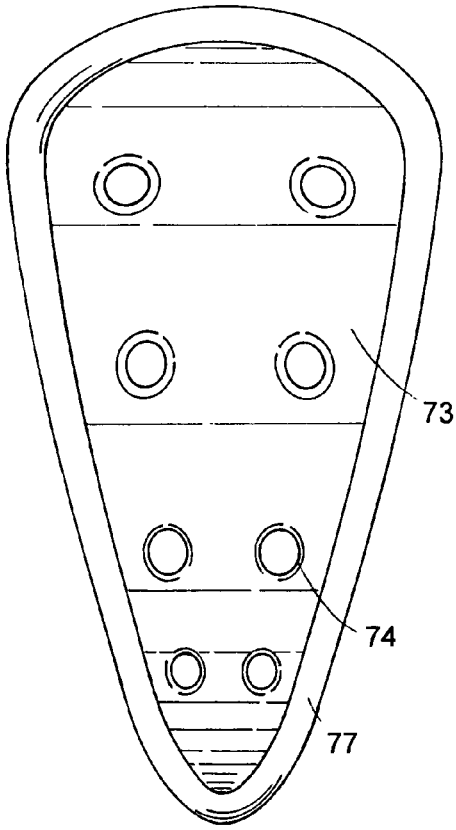
FIG. 20 is a back elevational view of the jock cup of FIG. 14.
Figure 21:
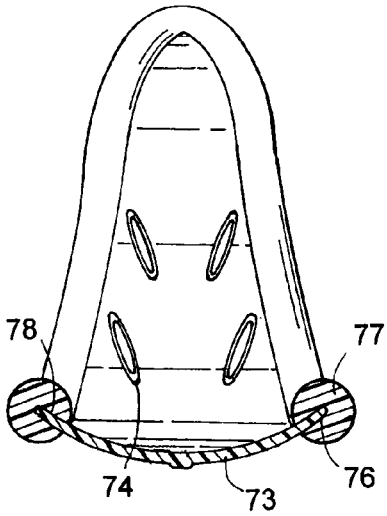
FIG. 21 is a sectional view taken along line 21-21 of FIG. 16.

Returning to FIGS. 2, 3 and 9, releasable fasteners 62, 63 and 64 secure cup pouch 41 to waist band 32 and the top of the middle section of body 31. Fasteners 62, 63 and 64 allow the location of cup pouch 41 to be vertically and horizontally adjusted relative to body 31 and waist band 32 to locate jock cup 52 in a user selected position. Fastener 62 includes a square loop pad 66 secured with stitches to one end of strap 61. Fastener 63 includes a square loop pad 67 secured with stitches to the end of strap opposite the one end of the strap. Fastener 64 is a rectangular loop pad 68 secured with stitches to the middle section of waist band 32 between pads 66 and 67 and an upper section of body 31. Pad 68 has a vertical dimension greater than the width of waist band 32 to allow for vertical adjustment of cup pouch greater than the width of waist band 32. As shown in FIG. 9, hook pads 69 and 71 are secured with stitches to opposite ends of the inside of strap 61. The opposite ends of strap 61 are turned back to provide additional support for the stitches that attach pads 69 and 71 to strap 61. A rectangular hook pad 72 is attached with stitches to the inside middle section of strap 61. Pad 72 has a horizontal length substantially equal to the horizontal length of loop pad 68. Fasteners 62, 63 and 64 are conventional Velcro connectors having releasable hook and loop pads. Other types of releasable connectors can be used to secure cup pouch 41 in selected adjusted positions on body 31 and waist band 32.

Jock cup 52, shown in FIGS. 14-21, has a rigid plastic member or body 73 having rows of holes 74. Body 73 has a generally V-shape with an outward convex curvature and an outer peripheral edge 76. Body 73 has downwardly converging side edges joined to an upwardly convex curved upper edge and a downwardly convex curved upper edge and a downwardly convex curved lower edge. A continuous flexible member 77 of compressible material is attached to edge 76. Member 77 is cylindrical rubber-like cushion of compressible material having an inwardly directed slot 78, shown in FIG. 21, accommodating peripheral edge 76 of body 73. Bonding material or an adhesive can be used to retain member 77 on body 73. Member 77 extends around edge 76 to provide a continuous cushion above, below and laterally of the entire edge 76.

Figure 22:
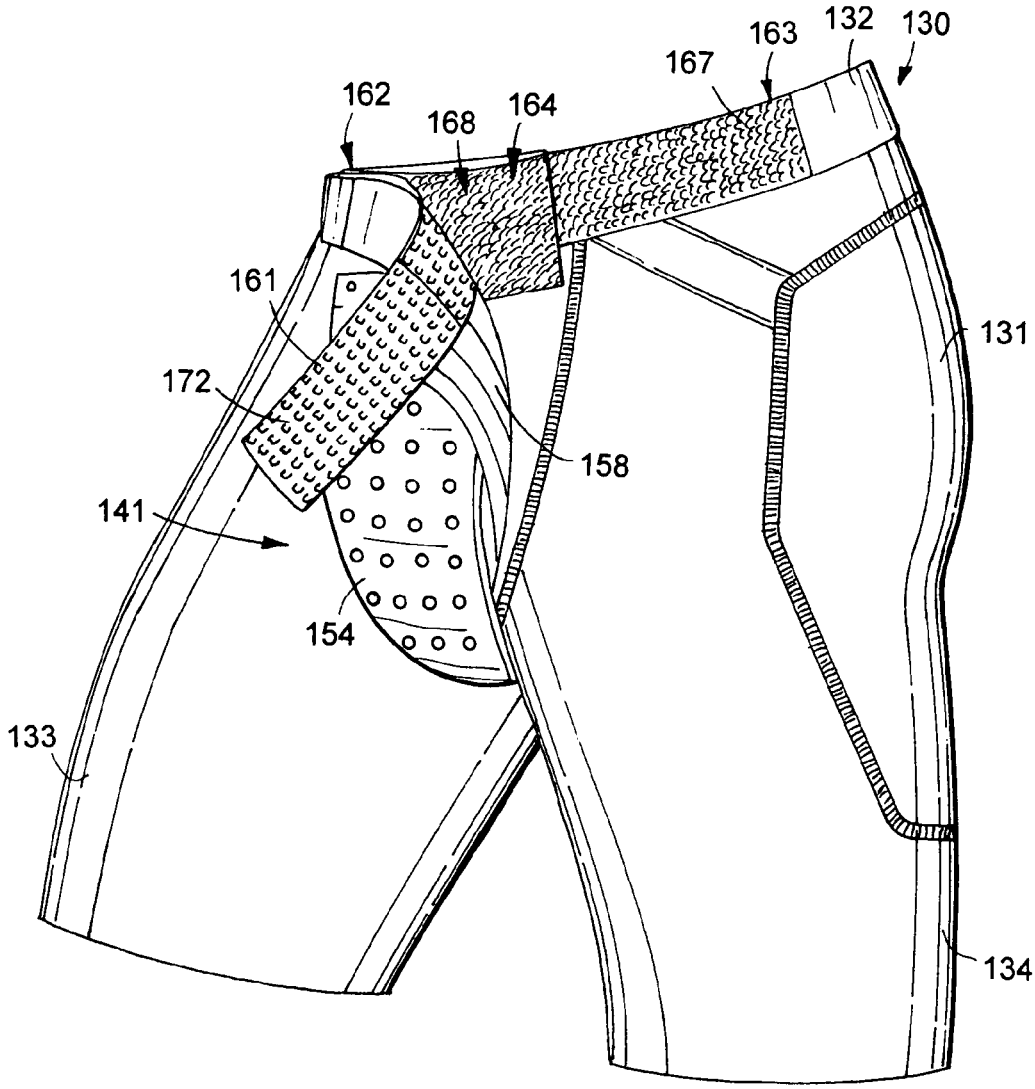
FIG. 22 is a perspective view of the modification of a athletic garment of FIG. 1.

A modification of the athletic garment 130, shown in FIG. 22 as a short pants, has a body 131 attached to a waistband 132. Short legs 133 and 134 extend downward from body 131. A cup pouch 141 is releasably secured to waist band 132 with end releasable fasteners 162 and 163 and middle releasable fastener 164. Releasable fasteners are Velcro hook and loop fasteners that allow the vertical and horizontal positions of cup pouch 141 to be adjusted relative to body 131 and waist band 132. Cup pouch 141 has the same structure as cup pouch 41 with corresponding parts having the same reference numbers with the prefix 1. A jock cup (not shown) is located within cup pouch 141. An example of the jock cup is shown in FIGS. 14-21.

Figure 23:
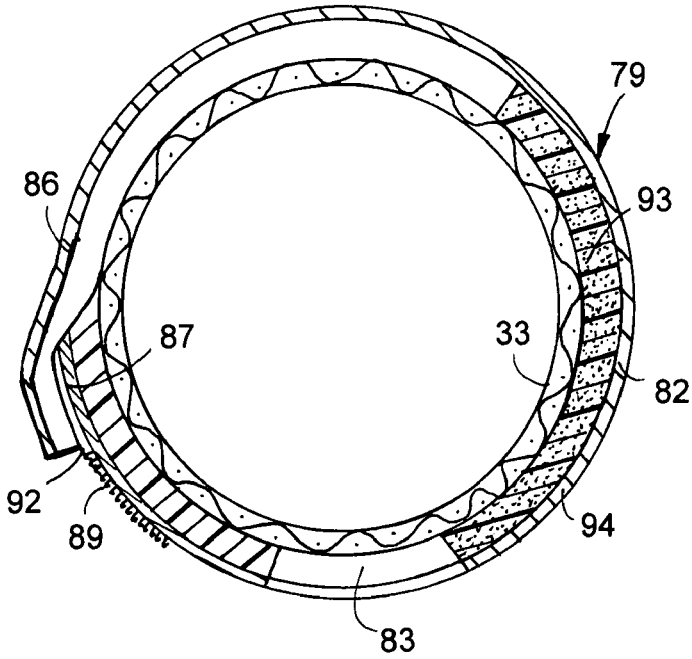
FIG. 23 is an enlarged sectional view taken along line 23-23 of FIG. 1.
Figure 24:
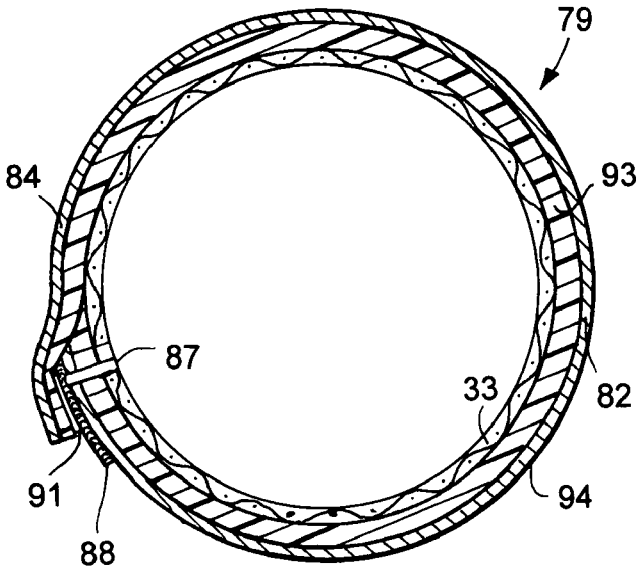
FIG. 24 is an enlarged sectional view taken along line 24-24 of FIG. 1.
Figure 25:
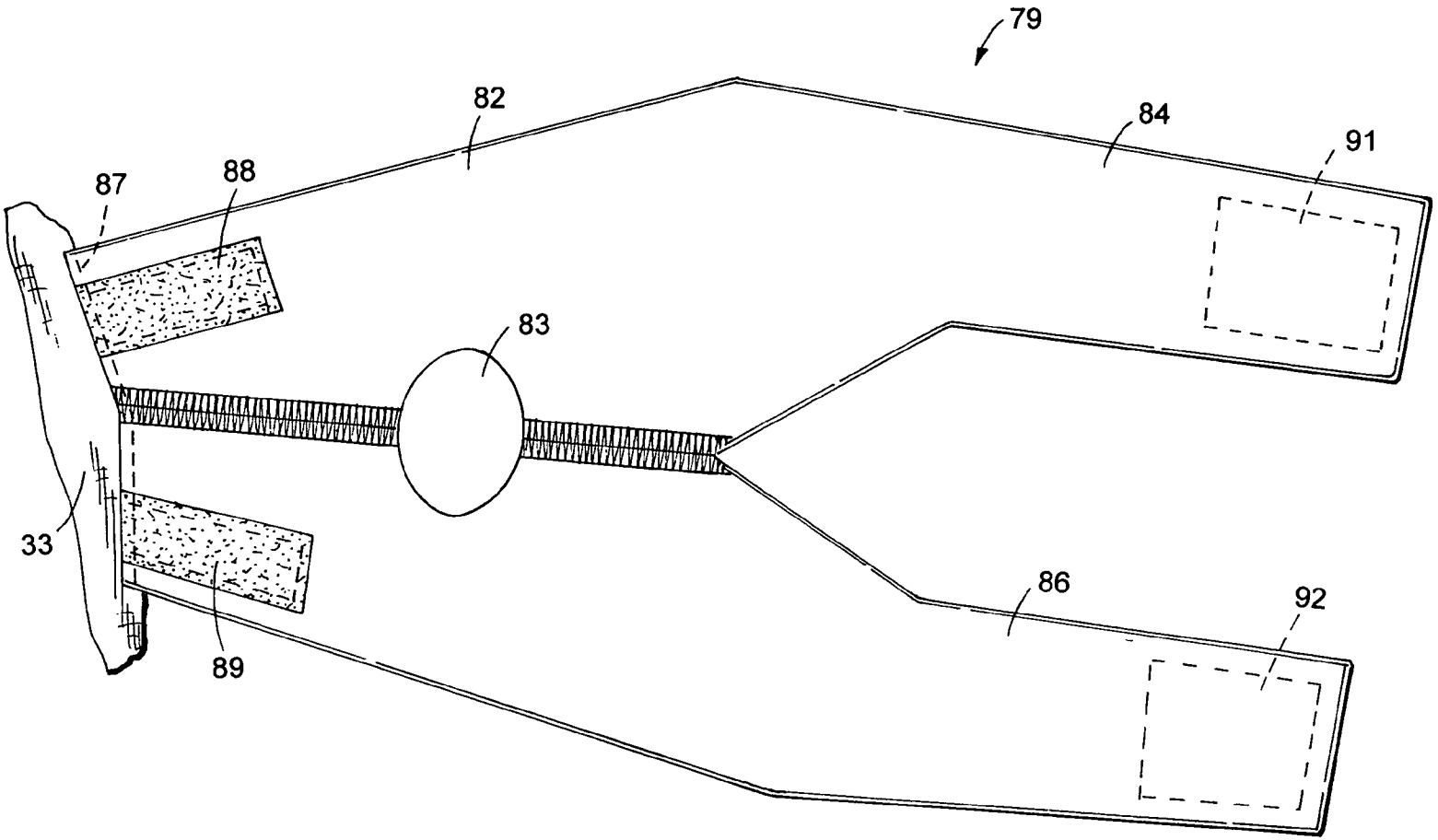
FIG. 25 is a front flat elevational view of the padded knee support of FIG. 1.
Figure 26:
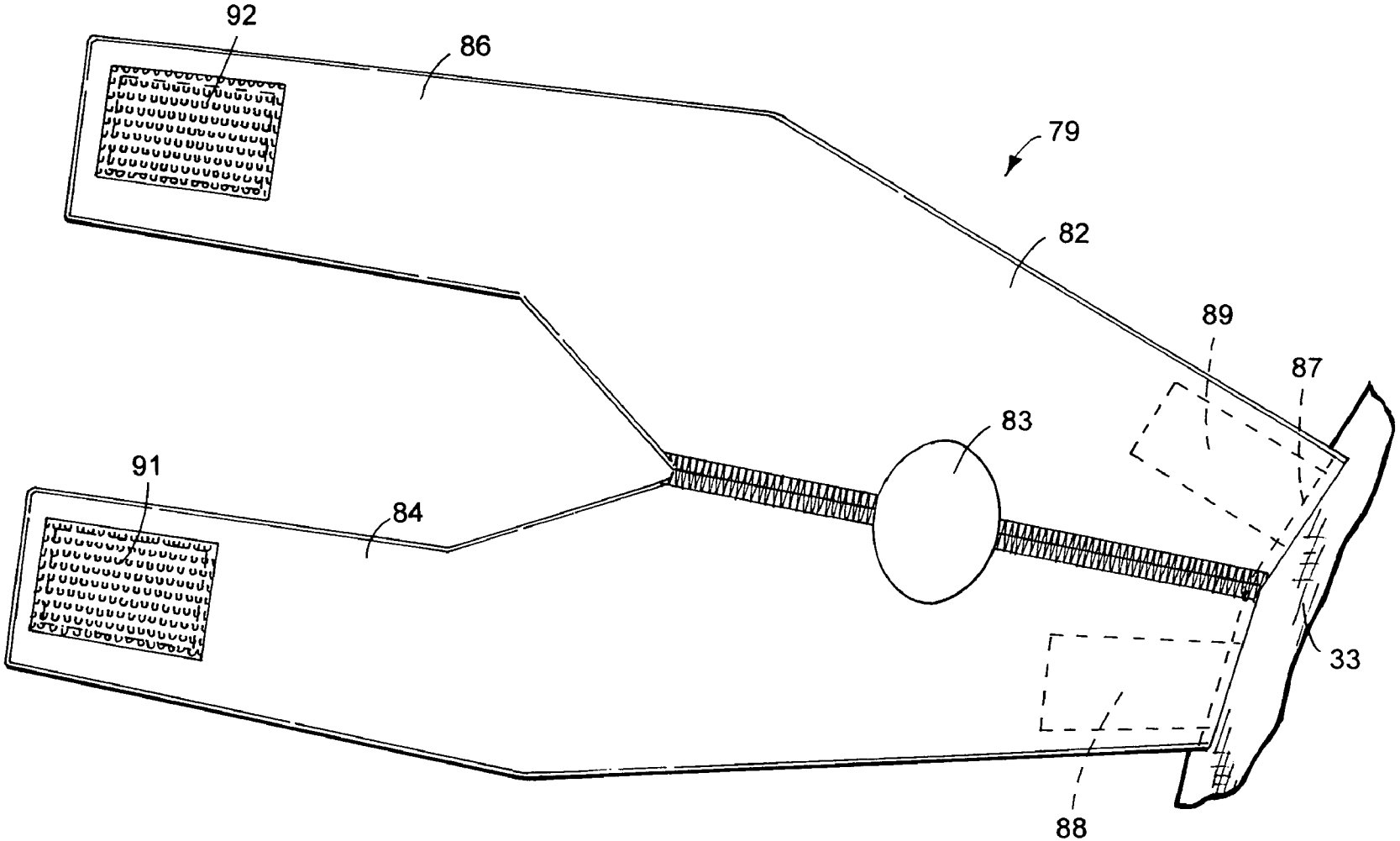
FIG. 26 is a rear flat elevational view of the padded knee support of FIG. 1.

Returning to FIG. 1, padded knee supports 79 and 81 surround knee sections of legs 33 and 34 to protect and reinforce the person's knees. Supports 79 and 81 are left and right supports having identical parts. Support 79 is described herein. As shown in FIGS. 25 and 26, support 79 has a body member 82 having a knee cap opening 83 and arms 84 and 86. One end of body member 82 is secured with connectors, shown as stitches 87 to an inside section of leg 33 thereby attaching support 79 to leg 33. A pair of loop pads 88 and 89 stitched to body member 82 adjacent leg 33 cooperate with hook pads 91 and 92 stitched to the remote ends of arms 84 and 86 to hold support around the knee of a person. Pads 88, 89, 91 and 92 are releasable connectors, known as Velcro hook and loop fasteners, that are adjustable to apply different compression pressure on and support for the knee. Other types of releasable fasteners can be used to secure support 79 around the knee of a person. Support 79 in the circular position around a knee of a person is shown in FIGS. 1, 23 and 24.

Leg 33 extended downward over the person's knee is surrounded by support 79. Hook and loop fasteners 91, 88 and 92, 89 are releasable Velcro connectors that releasably hold support 79 around the person's knee. Stitches 87 retain support 79 on leg 33 and maintain the location of support 79 on leg 33. Body member 82 and arms 84 and 86 have an inside cushion 93 of compressible material, such as open cell foam plastic and neoprene, covered with an outer sheet 93 of plastic or fabric. Other types of cushion materials and padding can be used for the structure of support 79 to protect the knee of a person and prevent injuries. Support 79 is a relatively thin knee protector that does not interfere with other equipment, such as hockey goalie pads, and baseball catchers shin protectors, used by an athletic person.

Several preferred embodiments have been shown and described for carrying out the invention. Changes in the structures, materials and arrangements of the elements of the athletic garment described herein can be made by persons skilled in the art without departing from the invention.

The invention claimed is:

1. An athletic garment for a person having a waist and legs comprising: a pants having a body, legs joined to the body and a waist band secured to the body adapted to fit around the waist of a person, a cup pouch, a jock cup located within the cup pouch, said cup pouch having a lower portion secured to the body and an upper portion, releasable fasteners securing the upper portion of the cup pouch in a selected position on the waist band, said releasable fasteners being adjustable whereby the selected position is adjustable to accommodate the person's body, said legs of the pants including knee sections adapted to surround the knees of the person, supports adapted to surround the knee sections and protect the knees of the person, connectors attaching the supports to the knee sections of pants, each of said supports having a body member and arms joined to the body member, said body member including an opening adjacent the front of the knee of the person, said connectors attaching the body member to a knee section of a leg of the pants, and releasable members secured to the body member and arms for connecting the arms to the body member and retaining the body member and arms around the knee of the person.

2. The garment of claim 1 wherein: the cup pouch has a generally V-shaped body having a pocket for the jock cup, and a strap secured to the body, said releasable fasteners being attached to the strap and waist band in selected positions to adjust the location of the cup pouch relative to the waist band.

3. The garment of claim 2 wherein the V-shaped body has a front member and a back member, said pocket being located between the front and back members.

4. The garment of claim 2 wherein: said releasable fasteners are hook and loop pads secured to the waist band of the pants and strap of the cup pouch.

5. The garment of claim 2 wherein: said releasable fasteners comprise a pair of first releasable connectors secured to opposite end portions of the strap and adjacent portions of the waist band and a second releasable connector secured to the strap between the first releasable connectors and adjacent portion of the waist band.

6. The garment of claim 5 wherein: said first and second releasable connectors are hook and loop pads.

7. The garment of claim 5 wherein: the second releasable connector secured to the waist band has a portion extended downwardly below the waist band of the pants.

8. The garment of claim 7 wherein: second connectors secure the portion of the second releasable connector to a front middle portion of the body of the pants.

9. The garment of claim 1 wherein: the jock cup comprises a rigid outwardly convex member having an outer continuous peripheral edge, and a cylindrical flexible member of compressible material surrounding and attached to the edge.

10. The garment of claim 9 wherein: the convex member has downwardly converging side edges, an upwardly curved convex edge joined to the side edges, and downwardly curved convex lower edge joined to the side edges, said flexible member surrounding and attached to said edges.

11. The garment of claim 10 wherein: said flexible member has a slot accommodating said convex and side edges.

12. The garment of claim 9 wherein: the convex member has a plurality of holes.

13. The garment of claim 1 wherein: each support includes a cushion of compressible material for protecting a knee of a person.

14. The garment of claim 1 wherein: said releasable members are hook and loop connectors for connecting the arms to the body member and adjusting the compression pressure of the body member and arms on a knee of the person.

15. An athletic garment for a person having a waist and knee comprising: a pants having a body, a waist band secured to the body adapted to fit around the waist of a person, a strap located adjacent the waist band, a cup pouch, a jock cup located within the cup pouch, said cup pouch having a lower portion secured to the body and an upper portion secured to the strap, and releasable fasteners securing the strap in a selected position on the waist band to accommodate the jock cup to the person's body, said releasable fasteners being attached to the strap and waist band, said releasable fasteners comprising a pair of laterally spaced first releasable connectors secured to opposite end portions of the strap and adjacent portions of the waist band and a second releasable connector secured to the strap between the pair of releasable connectors and adjacent portion of the waist band, said first and second releasable connectors being vertically and horizontally adjustable relative to the waist band to provide a comfortable fit of the jock pouch and jock cup on the person, said pants including legs joined to the body, said legs having knee sections adapted to surround the knees of a person, supports adapted to surround the knee sections and protect the knees of the person, each of said supports including an opening adjacent the front of the knee of the person, connectors securing a first portion of the support to the knee section and a releasable member securing the support around the knee of the person.

16. The garment of claim 15 wherein: the cup pouch has a generally V-shaped body having a pocket for the jock cup.

17. The garment of claim 16 wherein the V-shaped body has a front member and a back member, said pocket being located between the front and back members.

18. The garment of claim 15 wherein: said first and second releasable connectors are hook and loop pads secured to the waist band of the pants and strap of the cup pouch.

19. The garment of claim 15 wherein: the second releasable fastener has a portion extended downwardly below the waist band of the pants.

20. The garment of claim 19 wherein: connectors secure the portion of the second releasable fastener to a front middle portion of the body of the pants.

21. The garment of claim 15 wherein: the jock cup comprises a rigid outwardly convex member having an outer continuous peripheral edge, and a cylindrical flexible member of compressible material surrounding and attached to the edge.

22. The garment of claim 21 wherein: the convex member has downwardly converging side edges, an upwardly curved convex edge joined to the side edges, downwardly curved convex lower edge joined to the side edges and a plurality of holes, said flexible member surrounding and attached to said edges.

23. The garment of claim 22 wherein: said flexible member has a slot accommodating said convex and side edges.

24. The garment of claim 15 wherein: each of said supports has a body member and arms joined to the body member, said body member having the opening adjacent the front of the knee, said connectors attaching the body member to the knee section of a leg, and said releasable member securing the arms to the body member to retain the body member and arms around the knee of the person.

* * * * *